United States Patent [19]

Rossmann

[11] 4,334,822

[45] Jun. 15, 1982

[54] CIRCUMFERENTIAL GAP SEAL FOR AXIAL-FLOW MACHINES

[75] Inventor: Axel Rossmann, Karlsfeld, Fed. Rep. of Germany

[73] Assignee: MTU Motoren- und Turbinen-Union Munchen GmbH, Munich, Fed. Rep. of Germany

[21] Appl. No.: 156,499

[22] Filed: Jun. 4, 1980

[30] Foreign Application Priority Data

Jun. 6, 1979 [DE] Fed. Rep. of Germany ..... 2922835

[51] Int. Cl.[3] ..... F01D 11/00

[52] U.S. Cl. ..... 415/113; 415/127; 415/171; 415/174

[58] Field of Search ..... 415/113, 127, 128, 171, 415/174, 170 R, 135, 136, 134, 116

[56] References Cited

U.S. PATENT DOCUMENTS

| | | | |
|---|---|---|---|
| 2,598,176 | 5/1952 | Johnstone | 415/113 |
| 2,620,156 | 12/1952 | Parducci | 415/136 |
| 2,994,472 | 8/1961 | Botje | 415/174 |
| 3,227,418 | 1/1966 | West | 415/127 |
| 4,247,247 | 1/1981 | Thebert | 415/113 |

FOREIGN PATENT DOCUMENTS

| | | | |
|---|---|---|---|
| 1286810 | 1/1969 | Fed. Rep. of Germany | 415/136 |
| 318729 | 1/1972 | U.S.S.R. | 415/127 |

*Primary Examiner*—Leonard E. Smith

*Attorney, Agent, or Firm*—Scully, Scott, Murphy & Presser

[57] ABSTRACT

Circumferential gap seal for axial-flow machines including a metallic retaining flange mounted within the machine casing and which is connected to a metallic ring through flexible side walls, wherein the side walls, the metallic ring and the retaining flange are subdivided into a plurality of segments in the circumferential direction. The thereby formed radially directed gaps are sealed over the radial height of the side walls through flexible radial walls. The radial height is variable in dependence upon the measured size of the circumferential gap between the tip of the rotor blades of the machine and the metallic ring.

4 Claims, 2 Drawing Figures

CIRCUMFERENTIAL GAP SEAL FOR AXIAL-FLOW MACHINES

BACKGROUND OF THE INVENTION

1. Field of the Invention

The present invention relates to a novel circumferential gap seal for axial-flow machines.

In modern axial-flow machines (turbines or compressors) with their high pressure ratios, when giving consideration to the relatively short blade lengths, particularly stringent requirements are set in connection with the maintenance of small radial gaps between the rotor blade tips and the encompassing casing components, so as to ensure the required high degree of efficiency during all operating conditions. Due to unequal thermal and/or mechanical loading, the casing and rotors may be exposed to differing expansions under varying operating conditions, such as start, accelaration and shutdown or rundown whereby the radial gaps will, in essence, when the gaps become wider, the efficiency reduces, when they become narrower, this presents the danger of rubbing or fracture, particularly when the casing is distorted out of true round, in effect, assumes a polygonal or oval configuration.

2. Discussion of the Prior Art

Heretofore, attempts have been made to maintain the specified size of the circumferential gap under particular operating conditions (for example, start) by directed, intermittent blowing against the casings. However, this measure has proven itself as being inadequate both with regard to its effectiveness as well as long term applicability.

SUMMARY OF THE INVENTION

Accordingly, it is an object of the present invention to provide a novel circumferential gap seal for axial-flow machines which will ensure that the gap size will be maintained as exactly as possible under all operating conditions.

BRIEF DESCRIPTION OF THE DRAWINGS

Reference may now be had to the following detailed description of a preferred embodiment of the invention, taken in conjunction with the the accompanying drawings; in which.

DETAILED DESCRIPTION

Figure 2:
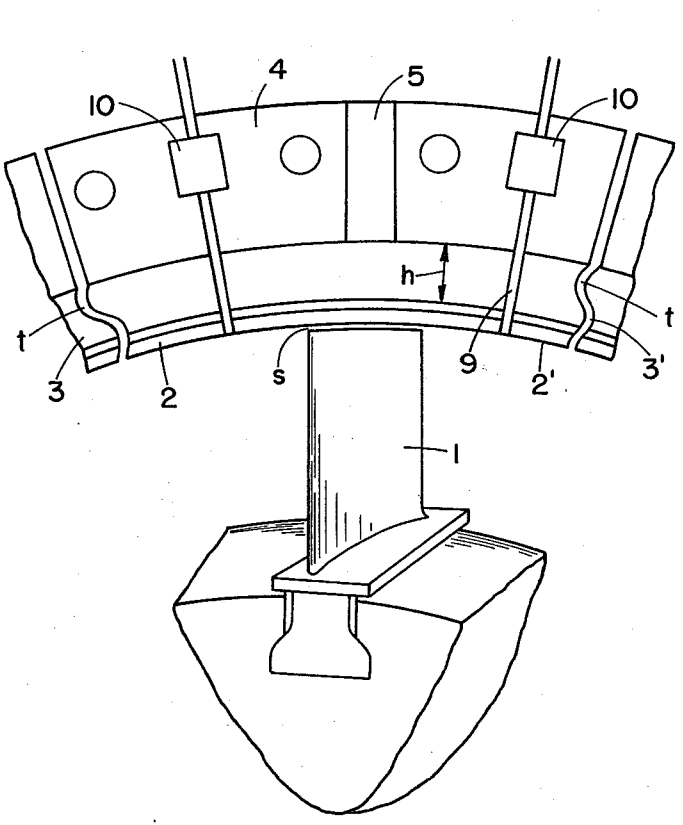
FIG. 2 illustrates a cross-section through an axial-flow machine.
Figure 1:
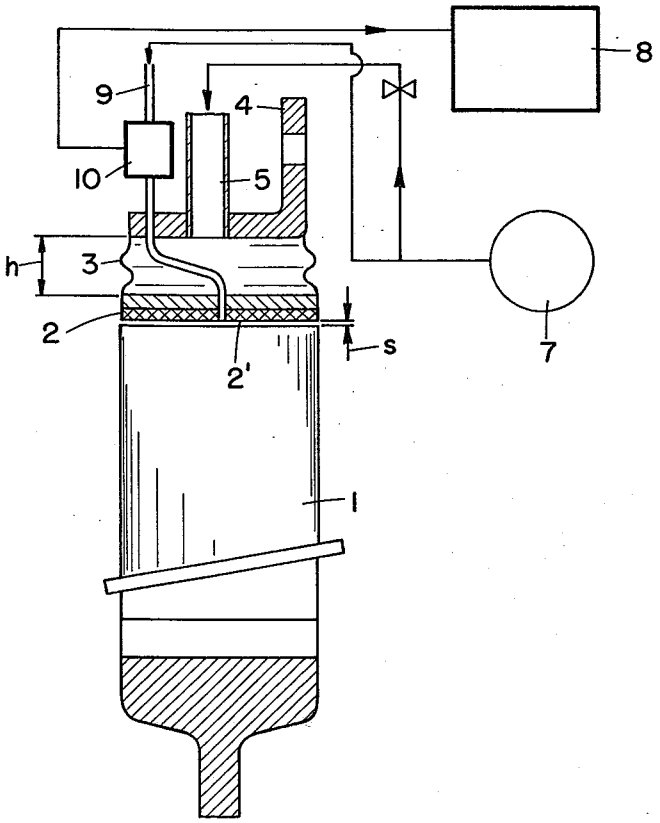
FIG. 1 shows the invention in a longitudinal section.

The blades 1 provide a circumferential gap s relative to an abradable contact coating 2' which is applied on a stationary metallic ring 2, for example, through spraying. The metallic ring is fastened through the intermediary of flexible side walls 3 of variable radial height h to a metallic retaining flange 4 which is connected with the casing. The flexible side walls 3 and the metallic ring 2, and if necessary also the retaining flange 4 are circumferentially subdivided into a plurality of segments; these segments each evidencing a radial gap t therebetween which is sealed over the height h through yieldable or flexible radial walls 3' which may be slideable in a radial direction. The thus formed bellows are connected to a compressed-air source 7 through attached conduits 5 and a common control valve 6.

The control valve is actuatable from a microprocessor 8 which receives signals dependent upon the circumferential gap size from a transducer 10. The transducer 10 is also connected to the compressed-air source 7 and so linked to the circumferential gap s through various sensing conduits 9, whereby a change in the size of the gap effects a change in the supplied air pressure. In lieu of this pneumatic transducer and sensors there can also be utilized capacitively, inductively or optically operating apparatuses. Finally, it is also possible to contemplate an adjustment of the segmented metallic ring 2 which is provided with flexible side walls 3 and radial separating walls 3' together with the abradable contact coating or liner 2' through other than the described pneumatic means, in effect, mechanically operating devices or through heating with hot gas or electrical current.

What is claimed is:

1. Circumferential gap seal for axial-flow machines, comprising a flow machine casing; a metallic retaining flange fastened to said casing; a metallic ring; an abradable contact lining provided on said ring; flexible side walls, said metallic ring being connected to said retaining flange through said flexible side walls, said metallic ring forming a circumferential gap with the tips of rotor blades of said machines, said flexible side walls, said metallic ring and said retaining flange being subdivided into a plurality of segments in the circumferential direction thereof; a radially directed gap being formed intermediate each said segment; flexible radial walls sealing said radial gaps over the radial height of said side walls; and sensor means arranged on said metallic ring for varying the radial height as a function of the size of said circumferential gap measured by said sensor means.

2. Circumferential gap seal as claimed in claim 1, said flexible side walls being slidable in a radial direction.

3. Circumferential gap seal as claimed in claim 1 or 2, said flexible side walls and radial walls forming a bellows; a compressed-air source; conduits connecting said bellows and said compressed-air source through a common control valve, said valve being actuatable in dependence upon the measured values of said circumferential gap sensor means.

4. Circumferential gap seal as claimed in claim 3, comprising a microprocessor for actuating said control valve; and a transducer connected to said compressed-air source and said sensor means communicating with said microprocessor.

* * * * *